United States Patent [19]

Petre

[11] Patent Number: 4,530,168

[45] Date of Patent: Jul. 23, 1985

[54] COMBINATION BOOT CARRYING AND DRYING DEVICE

[76] Inventor: Joseph E. Petre, 25 Annadale St., Armonk, N.Y. 10504

[21] Appl. No.: 590,113

[22] Filed: Mar. 16, 1984

[51] Int. Cl.[3] ..... F26B 25/00; A47F 7/08

[52] U.S. Cl. ..... 34/106; 224/257; 224/202; 211/35; 294/165

[58] Field of Search ..... 224/917, 257, 202; 294/165, 143, 146; 211/34, 35, 37; 34/104, 106, 239

[56] References Cited

U.S. PATENT DOCUMENTS

| | | | |
|---|---|---|---|
| 2,883,688 | 4/1959 | Barreca | 211/35 |
| 3,210,787 | 10/1965 | Allsop | 211/35 |
| 3,721,373 | 3/1973 | Penniman | 224/257 X |
| 4,192,424 | 3/1980 | Allsop | 211/37 |
| 4,312,532 | 1/1982 | Crump, Jr. | 294/165 |

*Primary Examiner*—Stephen Marcus
*Assistant Examiner*—David Voorhees
*Attorney, Agent, or Firm*—Wolder, Gross & Yavner

[57] ABSTRACT

A combination boot carrying and drying device, particularly for use with ski boots. A strap carries an adjustably positioned toe clip which detachably and firmly engages the front sole of a ski boot. The ends of the strap are secured to heel clips, which in addition to detachably engaging the heels of the boots, detachably grips a support member approximate a heat source. The strap is of sufficient length to allow the boots to be carried by the strap when the heel and toe clips are in position, and at the same time the boots may be positioned with the top facing downward so that the heat source may dry the interior of the boot when the heel clip grips the support.

13 Claims, 3 Drawing Figures

COMBINATION BOOT CARRYING AND DRYING DEVICE

BACKGROUND OF THE INVENTION

The present invention relates to a combination boot carrying and drying device, and more particularly to a device which may be used to secure and carry ski boots either by hand or over the shoulder, and at the same time may be used to detachably affix the ski boots to a support member approximate a heat source, so that the interior of the boots may be dried over a period of time, such as overnight, while the boots are not in use.

Devices of this nature are not unknown. There are carrying members for boots which may consist of a rigid support plank having heel and toe engagement members rigidly mounted on either side of the support member, and with a handle at one end. This may be used to carry boots to and from a skiing location. It is also known that if you place wet boots in the proximity of a heat source, you will ultimately have some kind of a drying effect on the interior of the boots. If the boots are placed, for example, near a fire or near a heater, on the floor, it is possible that some of the heat may work its way into the interior of the boot, but since heat rises, this is not a terribly efficient method of drying the boots. Furthermore, it is possible that there may be some type of drying racks, such as a pole affixed to a wall and the end of the pole may be received within the opening of a boot. Thus, if the boot is elevated, some of the heat, as it rises, will penetrate into the boots for a certain amount of drying. Obviously, these techniques are primitive, makeshift, and basically unsatisfactory, as well as inefficient.

Accordingly, it is among the principal objects of the present invention to provide a combination boot carrying and drying device.

Still yet another object of the present invention is to provide a device of the character described which provides a simple and efficient means for carrying boots, particularly ski boots.

Still yet another object of the present invention is to provide an improved boot carrying and drying device having a means which may simply and rapidly be secured to and detached from the heel and toe of a boot.

Still yet another object of the present invention is to provide an improved carrying and drying device in which the heel means carries an additional angle which engages an upstanding finger of a member secured to a support, such as a wall, so that the boots may be positioned above a reference plane, such as a floor, so that heat near the floor may travel upwardly and pass directly into the interior of the boots.

Still yet another object of the present invention is to provide means which engage the boots, and which are adjustable to accommodate varying boot sizes.

Still yet another object of the present invention is to provide a device of the character described which is simple and inexpensive to manufacture, and yet is durable to a high degree in use.

BRIEF DESCRIPTION OF THE INVENTION

In accordance with the above objects and advantages of the present invention, there is provided a combination boot carrying and drying device. Basically the device consists of a strap which is sufficiently long in its preferred state to adjustably receive toe clips and to which are secured at the ends heel clips, designed to engage and hold boots, preferably ski boots. The free middle portion of the strap is long enough to go over the shoulder so that the boots after being secured to the clips may hang at the sides of the user, while the center portion of the strap passes over the shoulder, thus the device may be used to carry the boots.

During the course of a day's skiing, snow often works its way into the interior of the boot, causing the interior to be wet, not only from the snow, but also from perspiration generated during skiing. Thus, the heel clips carry an extra extending portion forming a downwardly extending angle portion. This is designed to engage the upwardly extending support finger and abutment wall of an upwardly extending support, which is normally secured to the wall of an enclosure, such as a room. The width of the angle is comparable to the width defined by the abutment wall and the upper edge of the spacing of the support finger, and retains the boots extending outwardly in standard cantilever manner. The wall bracket is positioned above a source of heat, such as a baseboard heater, so that the heat, as it travels upwardly, penetrates directly into the opening interior of the boots, which are positioned upside down, thus facilitating drying of the interior. If these boots are retained in this manner overnight, are for some length of period of time, more efficient drying than has previously been possible, is obtained.

The above description, as well as further objects and advantages of the present invention will be more fully appreciated with reference to the following detailed description of a preferred, but nonetheless illustrative embodiment of the invention, when taken in conjunction with the following drawings, wherein.

DETAILED DESCRIPTION OF THE INVENTION

Figure 1:
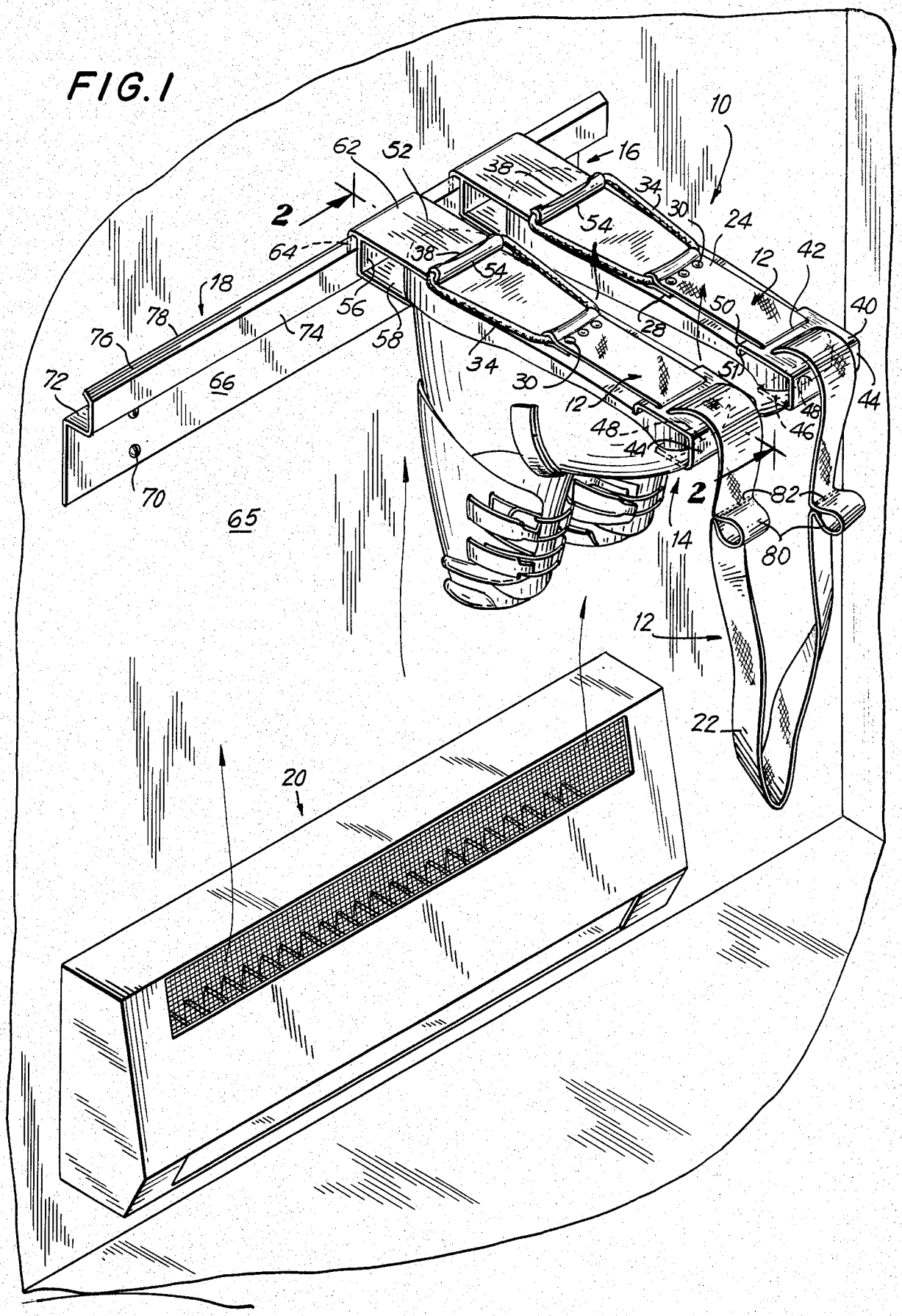
FIG. 1 is a front perspective view of the combination boot carrying and drying device, showing the boots in dripping position on the wall bracket positioned above a source of heat.

Turning to the drawings, and in particular FIG. 1, there is shown a boot carrying and drying device 10 broadly comprising a strap 12, toe clips 14, heel clips 16, the heel clips gripping a wall bracket 18 positioned above a heater 20.

The strap 12 may be made of any standard woven or non-woven material, or a natural or synthetic fabric, sufficient to withstand the rigors of winter and heat, and should be long enough so that its central portion 22 may either be carried over the hand or over the shoulder of a user. The end portion 24 (FIG. 2) has positioned in two places bores 26, and terminates in an edge 28. The portion 24 may be doubled over so that the bores are in alignment and rivets 30 pass through the bores, forming an end loop 32. Alternatively of course, the material may be sewn together, thus eliminating the need for the bores or the rivets.

Passing through the loop 32 is elastic rope 34, made of any standard elastic material having a certain amount of flexibility. The material may be joined together by means of sewing or a metal clamp or any convenient means, so that it may be replaced, if necessary. For purposes of illustration, the rope may have a forward end 36 which passes through the loop 32 and a rear end 38 for the purpose hereinafter appearing.

Figure 2:
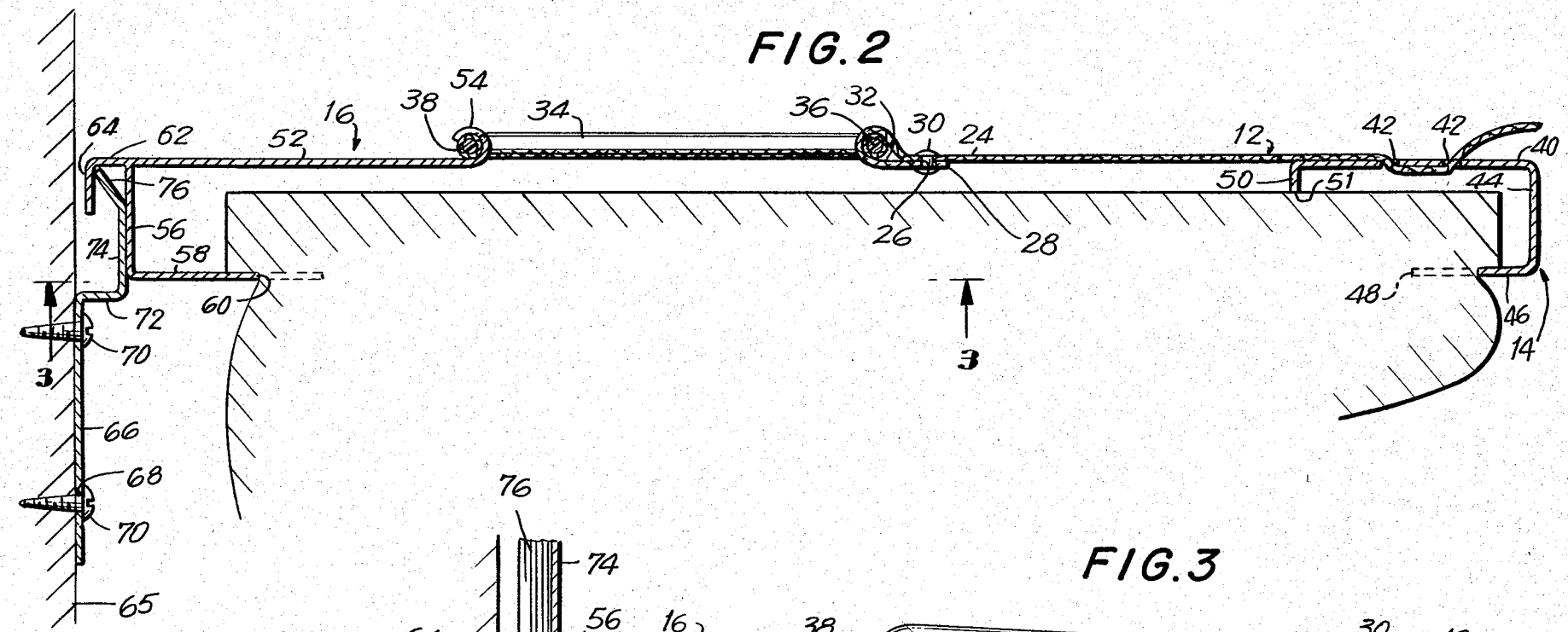
FIG. 2 is an enlarged, partly cut-away, cross-sectional view taken along the lines 2—2 of FIG. 1.

The toe clip 14 is designed to be adjustably movable along the length of the strap. The clip may be made of metal, or any high impact rigid plastic which will not be affected by heat. The clip is defined by an upper wall 40 (FIG. 2) having at least two slots 42 therein to allow passage of the strap 12 therethrough and allow sliding movement of the clip along the length of the strap in the well known manner. Depending downwardly to the right as seen in FIG. 2 from the upper wall 40 and perpendicular thereto is an end wall 44 and depending inwardly and perpendicular from the end wall 44 and parallel to the upper wall 40 is an engagement wall 46. As best seen in FIG. 1, the engagement wall has a leading curved edge 48. The edge 48 is curved and designed to accommodate the standard toe of any ski boot. The curve can be seen in dotted lines in FIG. 2, since the cross-section is taken at the center point or the point where the edge is closest to the wall 44, where the dotted lines show the portion where the edge 48 is farthest from the wall 44.

Looking at the upper wall 40 and to the left there is seen an abutment wall 50 which extends from the left edge at a right angle downwardly for a short distance towards the under surface of the boot, and terminating in an abutment edge 51. It is clear that when the toe clip is in position, the moment generating forces, especially after tension is applied to the strap is sufficient to retain the toe clip in position without it falling out of position from the boot.

Figure 3:
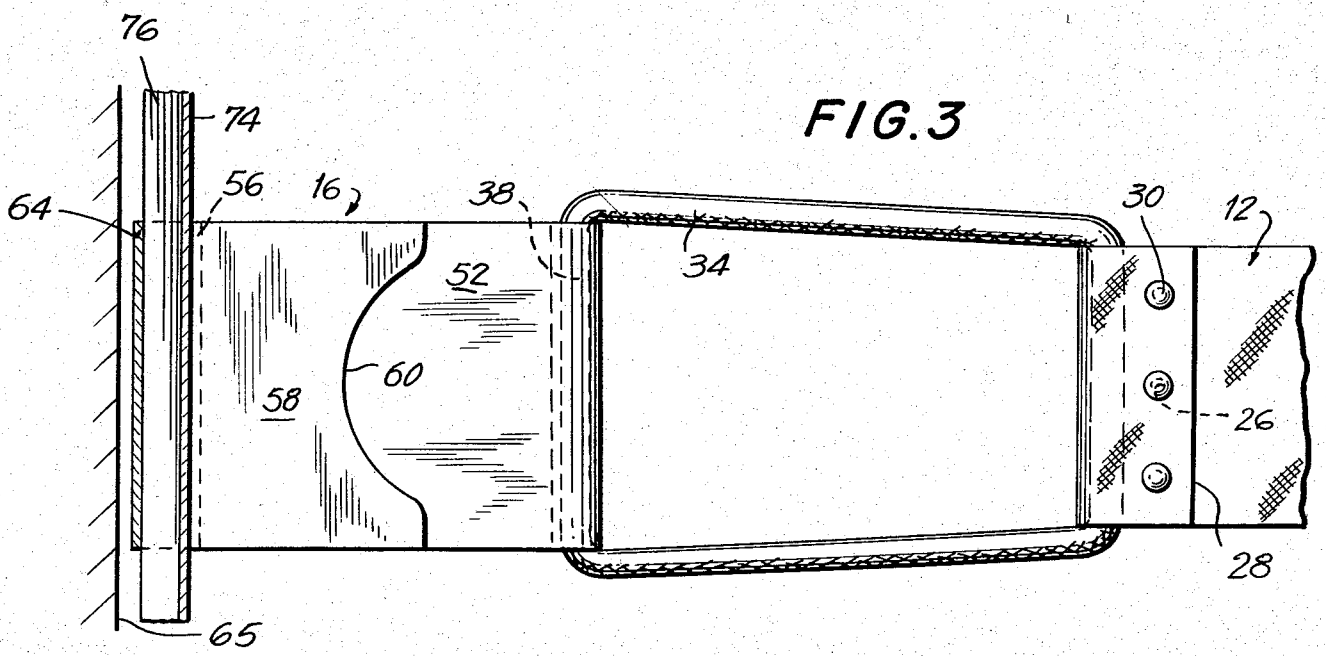
FIG. 3 is a further enlarged cross-sectional view, partly cut-away, taken along the lines 3—3 of FIG. 2.

The heel clip 16 is somewhat different in construction, but it is also made of either metal or a rigid plastic which is capable of withstanding higher temperatures. As best seen in FIGS. 2 and 3, the heel clip is defined by an upper wall 52 at the right end of which is a partial loop or engagement portion 54. This partial loop or engagement portion is designed to engage and retain the rear end 38 of the elastic rope 34. Alternatively, the engagement portion at the end of the clip may be a closed loop to insure a greater security and prevent the loss of the heel clip should it fall loose from the rope.

Depending downwardly and perpendicular from the wall 52 is an intermediate wall 56 which is designed to be sufficiently long to accommodate the heel of a standard ski boot. This may be a different length than the wall 44, or may be comparable to the length of the wall 44, as is illustrated in FIG. 2.

In a similar manner to the toe clip depending at a right angle and inwardly from the intermediate wall 46 is an engagement wall 48 having a curved edge 60, which is curved in design to accommodate the average curvature above the heel of a ski boot.

It is now obvious that when tension is placed on the strap 12, the moment generating forces in the toe clip 14 and the heel clip 16, via the elastic rope 34, is sufficient to maintain the both clips in position gripping the boot with sufficient tension and force to retain the boot, especially when the boot is carried by the user. Loops 80 formed by a line 82 of stitching may be used as finger grips to simplifiy the application of tension. Alternatively, the loop can be sewn back against the strap so it does not stand out in so prominent a manner. The loop is formed at a location on the strap which is beyond the length of the largest boot of this type.

The wall 52 depends further to the left beyond the intermediate wall 56 forming an extension 62 and from which depends a right angle wall 64.

The wall bracket 18 is secured to the side wall 65 of a standard room enclosure, and consists of a support wall 66 which abuts the wall 65, and may contain bores 68 through which pass screws 70 anchoring the bracket to the wall 65 in the well known manner. Depending outwardly in a right angle to the support wall 66 is a spacing wall 72 extending upwardly from the spacing wall perpendicular thereto and parallel to the wall 66 is an abutment wall 74 from which extends upwardly at an obtuse angle, a support finger or wall 76.

It can easily be seen that the length of the extension 62 is equal to the distance between the wall 74 and the upper edge 78 of the support finger 76. The turning moments created by the weight of the boot create a counter-clockwise force around the wall 74, 76 with the wall 56 abutting the wall 74 and the wall 64 engaging the upper edge 78 of the wall 76 causing a cantilever and creating a counter-clockwise force, also in the well known manner.

After returning from the skiing area, with the boots carried by the clips in place with the strap 12 via its central portion 22 over the shoulder of the user, the toe clips may be positioned over the bracket 18 as described above, with the openings of the boots facing downwardly. A source of heat, such as the baseboard heater, may then be turned on and because of the fact that hot air rises, the heat will pass upwardly and into the interior of the boots. The boots may be retained in this position for a specific period of time until such time as the boots are dry, or may be retained in this position overnight, until the user again wishes to utilize the boots, the following morning.

Thus there is provided a very simple and economical means for carrying the boots and for retaining the boots in an appropriate efficient position for the maximum benefit of drying from a source of heat, all well within the budget of the average skier.

It should also be noted that the invention may be used to store the boots when they are not in use. Either the heat source is not used, or another wall bracket is placed where there is no heat source.

As can been seen, the present invention provides a significant advance over the state of the technology. As numerous additions, modifications and constructions can be performed within the scope of the invention, such scope is to be measured by the claims herein.

What is claimed is:

1. In combination, a boot carrying and drying device, which comprises:

(a) a support;

(b) mounting means secured to the support, said mounting means having a mounting portion;

(c) a carrying and mounting means which detachably engages the mounting means, having (i) a strap;

(ii) first boot engagement means, detachably engagable with one of the heel and toe of the boot;

(iii) second boot engagement means, detachably engagable with the other of the heel and toe of the boot;

(d) said first and said second boot engagement means adjustably attached to said strap, so that different size boots may be accommodated, with a sufficient length of strap remaining to allow the attached boots to be carried by hand or over the shoulder;

(e) one of said first and second engagement means having a mounting portion which detachably grips the mounting portion of said mounting member;

whereby, the strap and boot engagement means may be secured to and adjustably carry any size boot, and may be mounted on the mounting member to allow drying of the interior of the boot.

2. The invention according to claim 1, wherein the combination further includes a source of heat to provide more efficient means for drying the interior of the boots.

3. The invention according to claim 2, the source of heat being positioned below the support and hence below the boots.

4. The invention according to claim 2, wherein one of the engagement means is a heel clip secured to the end of the strap.

5. The invention according to claim 4, the other engagement means being a toe clip, slidably mounted on the strap and detachably secured to the toe of the boots.

6. The invention according to claims 4 and 5, an elastic rope rotatably secured to the ends of the strap, and rotatably secured to the heel clip.

7. The invention according to claim 6, the ends of the strap folded over against itself to form a loop, the elastic rope passing through the loop.

8. The invention according to claim 7, the ends of the strap secured to itself by means of rivets.

9. The invention according to claim 7, the ends of the strap being secured to itself by means of stitching.

10. The invention according to claim 4, the heel clip having an extended angle portion which detachably grips the mounting portion of the mounting member.

11. The invention according to claims, 1, 3 and 9, wherein the mounting means includes a wall bracket secured to the support, the wall bracket having an upwardly extending finger spaced from the support.

12. The invention according to claim 11, the heel clip having an extending angle portion designed to receive the finger of the support.

13. The invention according to claim 5, wherein the strip is formed with finger gripping means at a distance from the ends of the straps greater than the length of largest sized ski boots.

* * * * *